United States Patent [19]

Koehlinger et al.

[11] 4,131,230

[45] Dec. 26, 1978

[54] TWELVE BOTTLE CARTON

[75] Inventors: Allen W. Koehlinger; Norman J. Fox, both of Cincinnati, Ohio

[73] Assignee: R. A. Jones & Co. Inc., Covington, Ky.

[21] Appl. No.: 873,276

[22] Filed: Jan. 30, 1978

[51] Int. Cl.[2] ..... B65D 5/02

[52] U.S. Cl. ..... 229/40; 206/158

[58] Field of Search ..... 229/40; 206/158

[56] References Cited

U.S. PATENT DOCUMENTS

| | | | |
|---|---|---|---|
| 3,090,520 | 5/1963 | Wuerthner | 206/158 |
| 3,176,902 | 4/1965 | Champlin | 229/40 |
| 3,224,577 | 12/1965 | Hansen | 206/158 |
| 3,356,283 | 12/1967 | Champlin | 229/40 |
| 3,405,840 | 10/1968 | Champlin | 229/40 X |

*Primary Examiner*—Davis T. Moorhead

*Attorney, Agent, or Firm*—Wood, Herron & Evans

[57] ABSTRACT

A carton for twelve bottles, the carton having a bottom panel, end panels and a top panel. The top panel is divided into a center section, two intermediate sections and two side sections connected together on hinge lines. Openings are formed on the hinge lines to receive the necks of bottles. A first row of bottles is inserted into each side of the carton with the necks lodged on the ends. The intermediate sections are swung to horizontal position to capture the first rows of bottles in the openings at the hinge lines. A second row of bottles is inserted into each side of the carton, and the side sections are swung downwardly to capture the second rows of bottles in the openings. The side sections are then sealed to side flaps.

4 Claims, 9 Drawing Figures

TWELVE BOTTLE CARTON

This invention relates to a carton for bottles, and more particularly, the invention is directed to a carton which substantially completely encloses twelve bottles.

Beer which is sold in cans is available in packs of twelve. A twelve pack of cans is not too difficult to package in view of the fact that there is no requirement for container separation. Bottled beer, however, is sold usually in six packs and eight packs and in both the bottles are aligned in two rows. One such six pack is shown and described in patent No. 3,090,520. Until the time of the present invention, there has not been provided any satisfactory way of packaging twelve bottles in a single three-by-four pack without separate partitions to provide bottle separation.

While there are on the market several twelve packs, these are characterized by the provision on either specially attached or separately inserted partitions to maintain bottle separation. The disadvantages of these twelve packs are that they require more total board in the package and either more complex machinery to insert the partitions and load or a slower loading process.

An objective of the present invention has been to provide a paperboard carton for twelve bottles, the carton providing suitable separation of the bottles without separate partitions with respect to each other in order to avoid the bottles coming into contact with one another during shipping and handling.

Another objective of the invention has been to provide a twelve pack carton which is adaptable for machine loading using cartoning machinery of the type currently employed in loading the cartons of patent No. 3,090,520.

The objectives of the invention are achieved by providing a carbon having a top panel with intermediate and side sections hinged to a center section and openings on the hinge lines of the respective sections within which the necks of the bottles are captured and held slightly spaced from one another.

The top panel configuration referred to above permits the following sequence of loading operations which begin with the side and intermediate sections in an upward attitude thereby opening the carton for the introduction of bottles. In the sequence of operations, a first row of three bottles is introduced into the carton through each side of the carton until the necks of the bottles are lodged in the hinge line openings between the center section and the intermediate sections.

The intermediate sections are then brought to a horizontal attitude with the side sections still being directed upwardly. In this orientation, the first rows of bottles are securely captured in the hinge line openings, but the sides of the carton remain open to receive second rows of bottles.

The second rows of bottles are inserted into the carton until their necks lodge in the openings on the hinge lines between the intermediate and side sections. The side sections are then swung downwardly upon the shoulders of the bottles and glued to side flaps to capture the necks of the bottles and complete the loading of the carton.

Another feature of the invention has been to provide a double-ply or double thickness bottom wall and to strike from that bottom wall tabs which are adapted to project upwardly into the spaces between adjacent bottles. Because the bottom of the carton is two plies, the tabs will also be two plies, thereby providing substantial separation of the bottles from one another, this being a requirement of Rule 41 of the Uniform Freight Classification. This tab separation of the bottles, coupled with the capturing of the necks of the bottles in the hinge line holes, securely maintains the bottles from banging against one another during handling.

In the preferred form of the invention, the tabs are formed with slightly offset hinge lines so that the tabs from the two plies may be swung up without binding upon one another.

The several objectives and features of the invention will become more readily apparent from the following detailed description taken in conjunction with the accompanying drawings in which.

Figure 1:
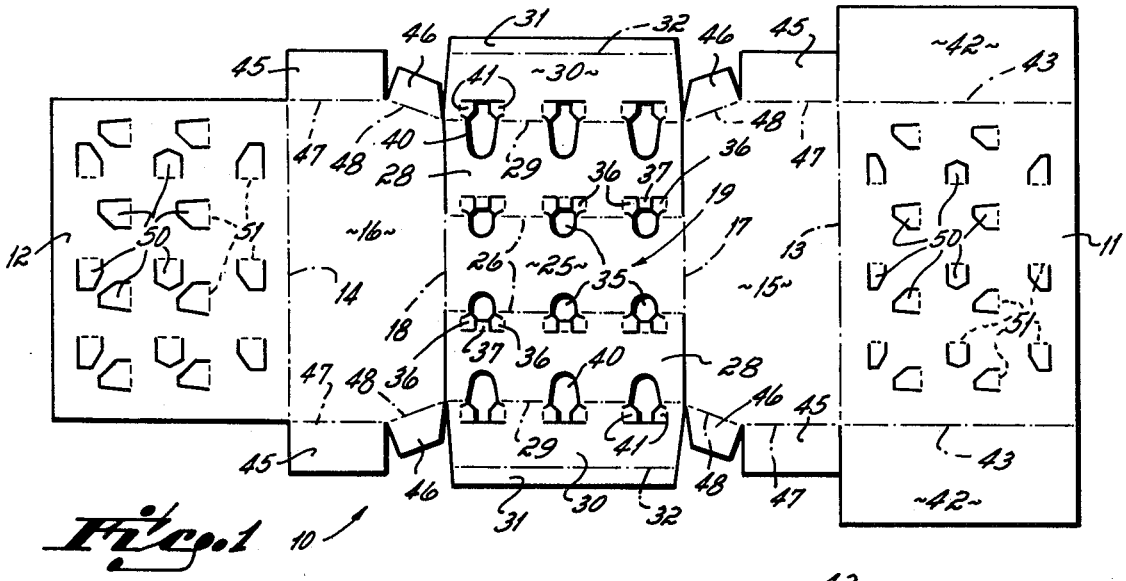
FIG. 1 is a plan view of a carton blank in accordance with the present invention.

Referring to FIG. 1, a blank 10 has an outer bottom panel 11 and an inner bottom panel 12. The bottom panels are connected along hinge lines 13 and 14 to end panels 15 and 16, respectively. The end panels are connected along hinge lines 17 and 18 to a top panel 19. The top panel 19 has a center section 25 which is hinged along lines 26 to intermediate sections 28. The intermediate sections are hinged along lines 29 to side sections 30. Each side section 30 has a glue flap 31 connected to it along a tear line 32. Three openings 35 are formed along each hinge line 26. Each opening is defined in part by lateral flaps 36 and a center flap 37 which engage under the lifting ring portion of the finish of the bottle. Similar openings 40 are located along the hinge lines 29 and are partially defined by lateral flaps 41. The openings 35 and 40 are bisected by the respective hinge lines 26 and 29 so that the openings 35 and 40 can be opened up to receive the necks of bottles when the respective intermediate and side sections are swung upwardly.

The outer bottom panel has side flaps 42 hinged to it along lines 43. The end panels 15 and 16 have side flaps 45, 46 hinged to them along lines 47 and 48. Each bottom panel 11, 12 has a plurality of tabs 50 struck from the surface of the panel but remaining attached to the panel by hinge line 51.

Figure 2:
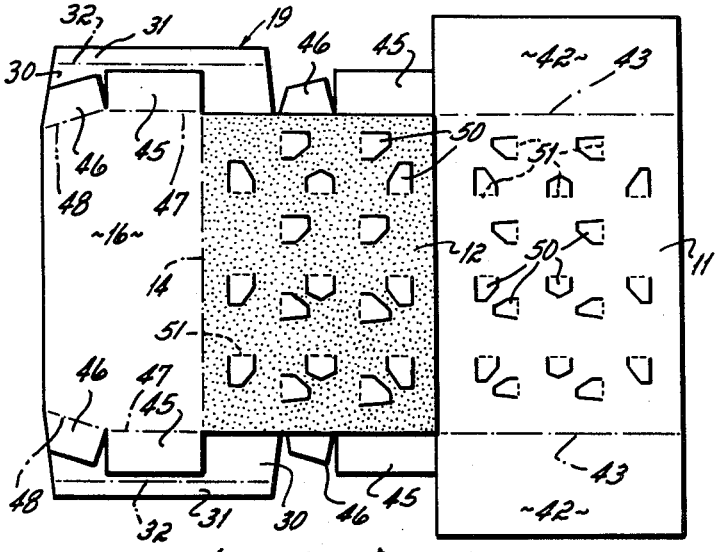
FIG. 2 is a plan view of a partially folded blank.

The blank is prepared for loading with a twelve pack of bottles by first applying glue to the inner bottom panel 12 over a substantial area while leaving free from glue the tabs 50, as shown in FIG. 2.

The outer bottom panel is adhesively secured except for tab area to the inner bottom panel, and the tabs 50 on the respective panels are in alignment except that the hinge lines of the tabs in the inner bottom panel 12 are slightly offset from the hinge lines of the tabs in the outer bottom panel. Thus, when these tabs are projected upwardly into the carton, the offset orientation of the hinge lines, coupled with the absence of adhesive, permits the tabs to be thrust upwardly without binding upon one another.

Figure 3:
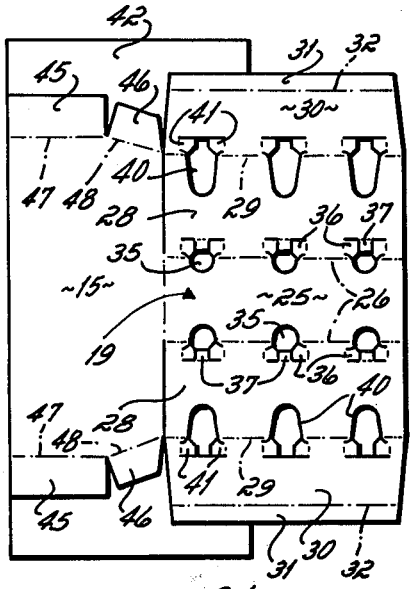
FIG. 3 is a plan view of a completely folded blank.
Figure 4:
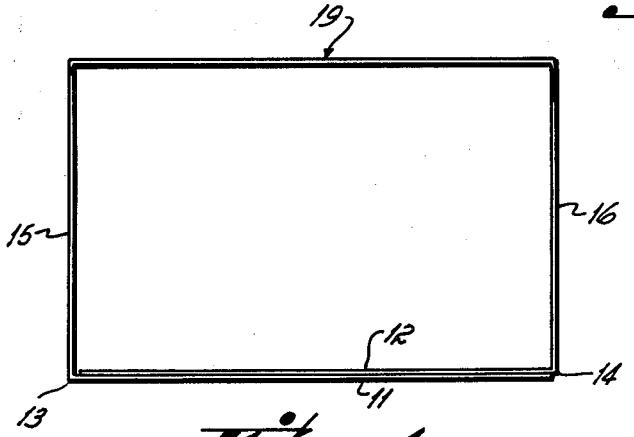
FIG. 4 is an end elevational view of a blank in erected condition.

With the bottom panels secured to each other, thus forming a double thickness or double-ply bottom panel, the blank is in the configuration shown in FIG. 3 ready for erecting in an automatic machine. The blanks can be filled by machinery generally of the type shown in patent No. 3,225,510, the machine being modified to accommodate four rows of bottles as contrasted to the two rows of bottles normally loaded into a six pack.

Figure 5:
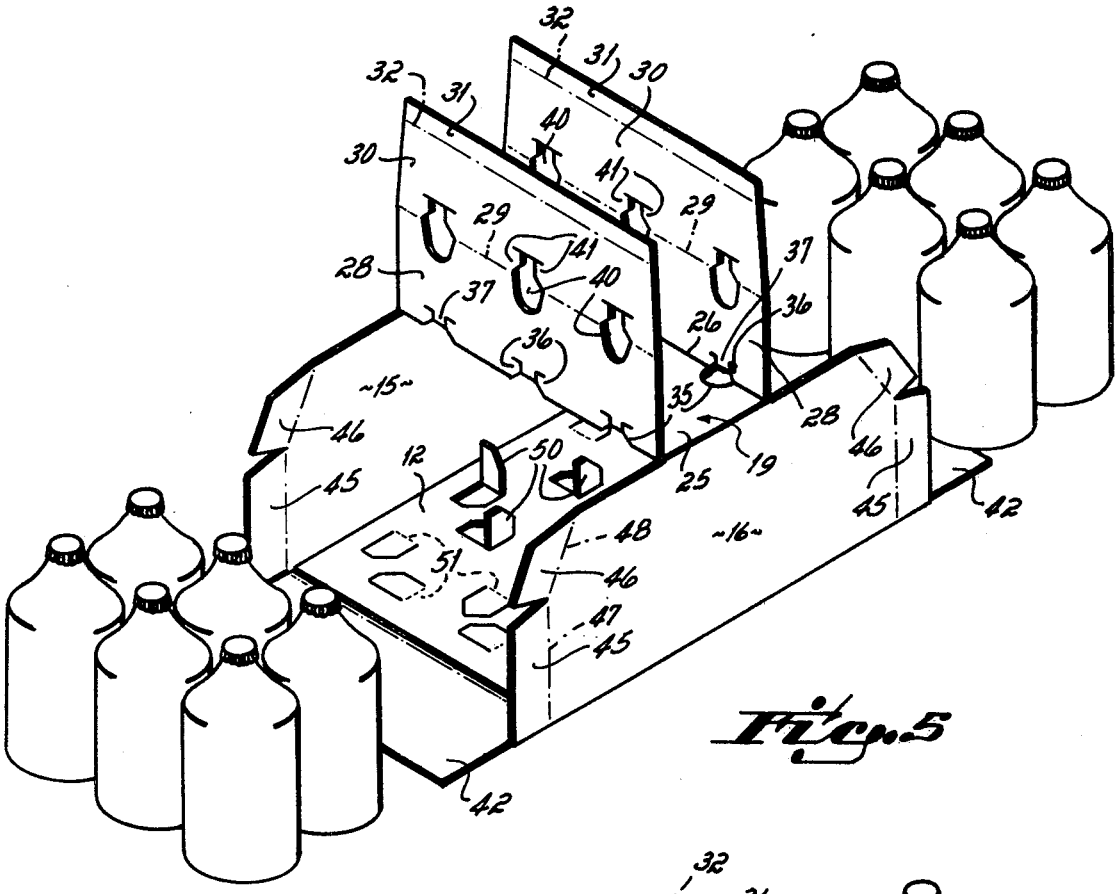
FIG. 5 is a perspective view of the blank and the bottles about to be loaded into it.

Prior to the loading operation, the intermediate and side sections 28 and 30 of the top panel are swung upwardly, as shown in FIG. 5. Also, the tabs 50 at the center portion of the carton are thrust up to a vertical orientation as shown in FIG. 5 in proper sequence as the first row of bottles is being slid into the carton until the neck of each bottle is captured in the horizontal portion of the hole 35 in the center section 25. In this position, each bottle will be in engagement with one or more tabs 50 which serve to separate the bottles from each other.

Figure 6:
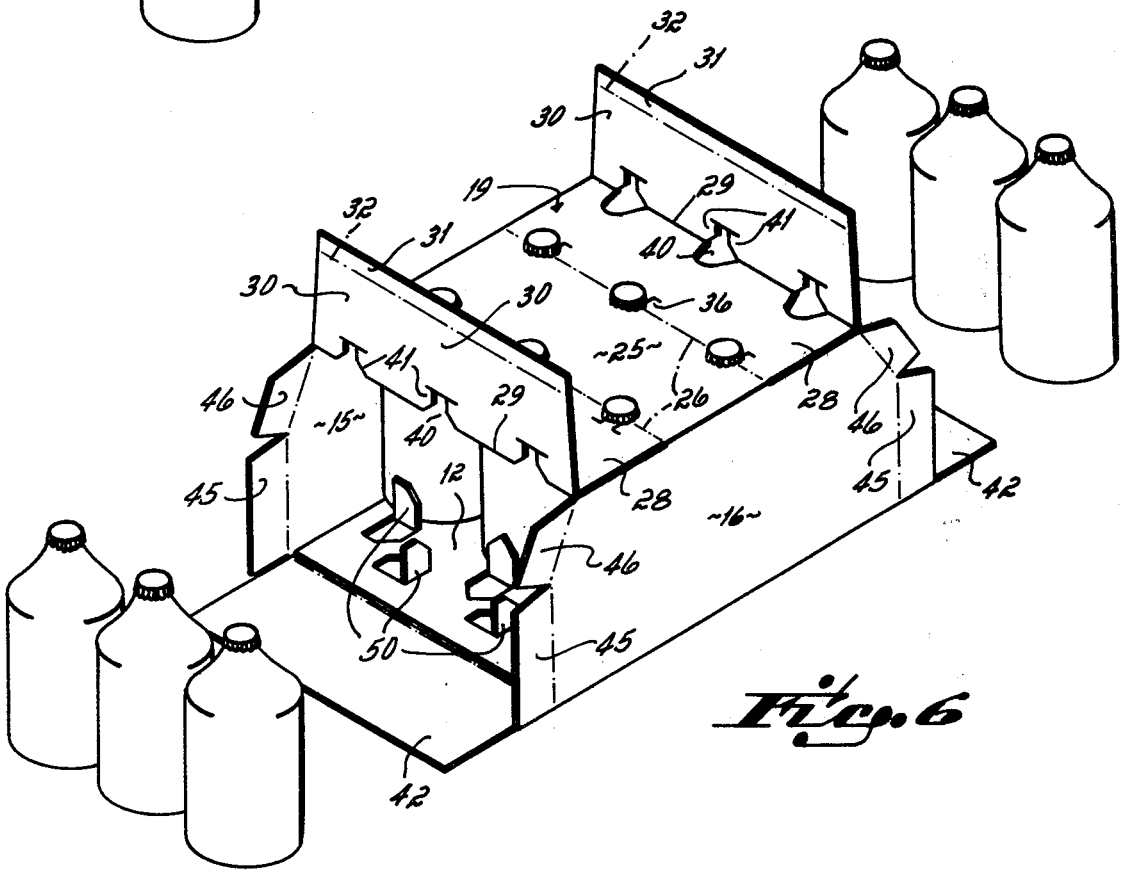
FIG. 6 is a perspective view of the blank partially loaded with bottles
Figure 7:
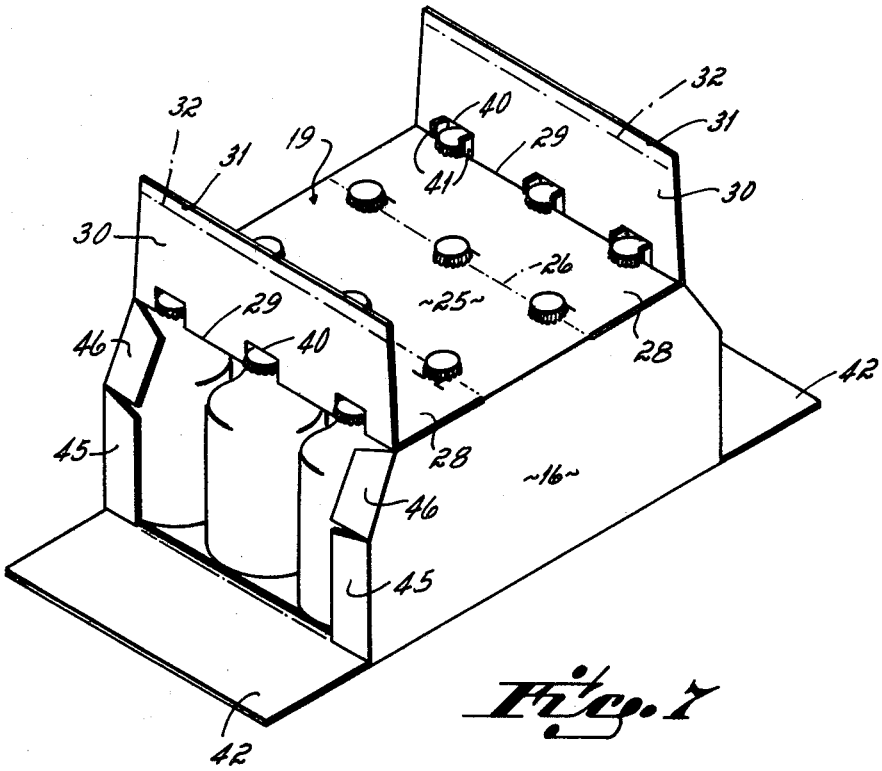
FIG. 7 is a perspective view of the blank with the bottles fully loaded into it.

When the bottles are in position, the intermediate section 28 of the top panel is swung downwardly to a horizontal position while the side sections 30 still project upwardly. In this operation, the lateral and center flaps 36, 37 flex upwardly as they pass over the cap and finish of each bottle and engage under the finish to restrain lateral movement of the bottle. With the side sections 30 still projecting upwardly, an opening is formed for the second row of bottles to be introduced on each side of the carton. The separation tabs 50 are swung up into the position shown in FIG. 6 sequentially as the second row of bottles is being slid into the carton until the necks engage the openings 40 as shown in FIG. 7. In this position, the engagement of the necks with the opening spaces the upper portions of the bottles away from the adjoining inner rows of bottles. The lower portions of the bottles are spaced from each other by the upwardly-projecting tabs 50.

The package is completed by first swinging the flaps 45, 46 inwardly to overlie the adjacent bottles, swinging side flaps 42 attached to the bottom panel upwardly, and swinging the side section 30 downwardly. Glue previously applied, preferably on inner and outer surfaces of flap 42, or as otherwise desired, causes flaps 31, 45, and optionally 46, to adhere to flap 42 and form a substantially completely closed package surrounding the bottles.

Figure 8:
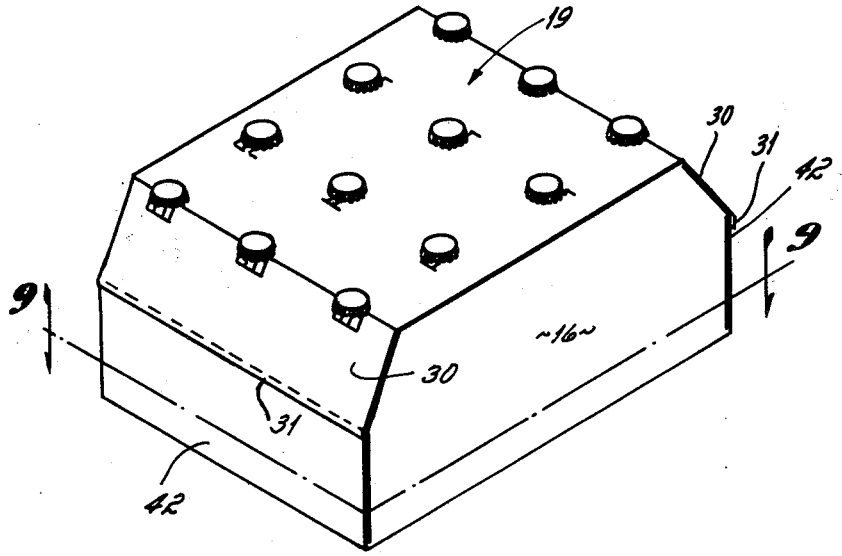
FIG. 8 is a perspective view showing the package completely formed.

When the first rows of bottles are introduced into the carton and the intermediate sections of the tap panel lowered to a horizontal attitude, the flaps 36 and 37 at each opening 35 ride down over the bottle cap and crown finish and engage under the lifting or reinforcing ring of each bottle, as stated above, thereby securing the bottle against outward movement. Similarly, the outer rows of bottles are captured in the holes 40 when the side sections are swung down to the position shown in FIG. 8. Again, the flaps 41 at each hole engage under the lifting ring of the bottle finish and secure the bottle against lateral movement. A flap comparable to center flap 37, associated with opening 35, is not needed in the opening 40 since outward movement of the bottles is prevented by the enclosing of the bottles by flaps 46 and side sections 30.

Figure 9:
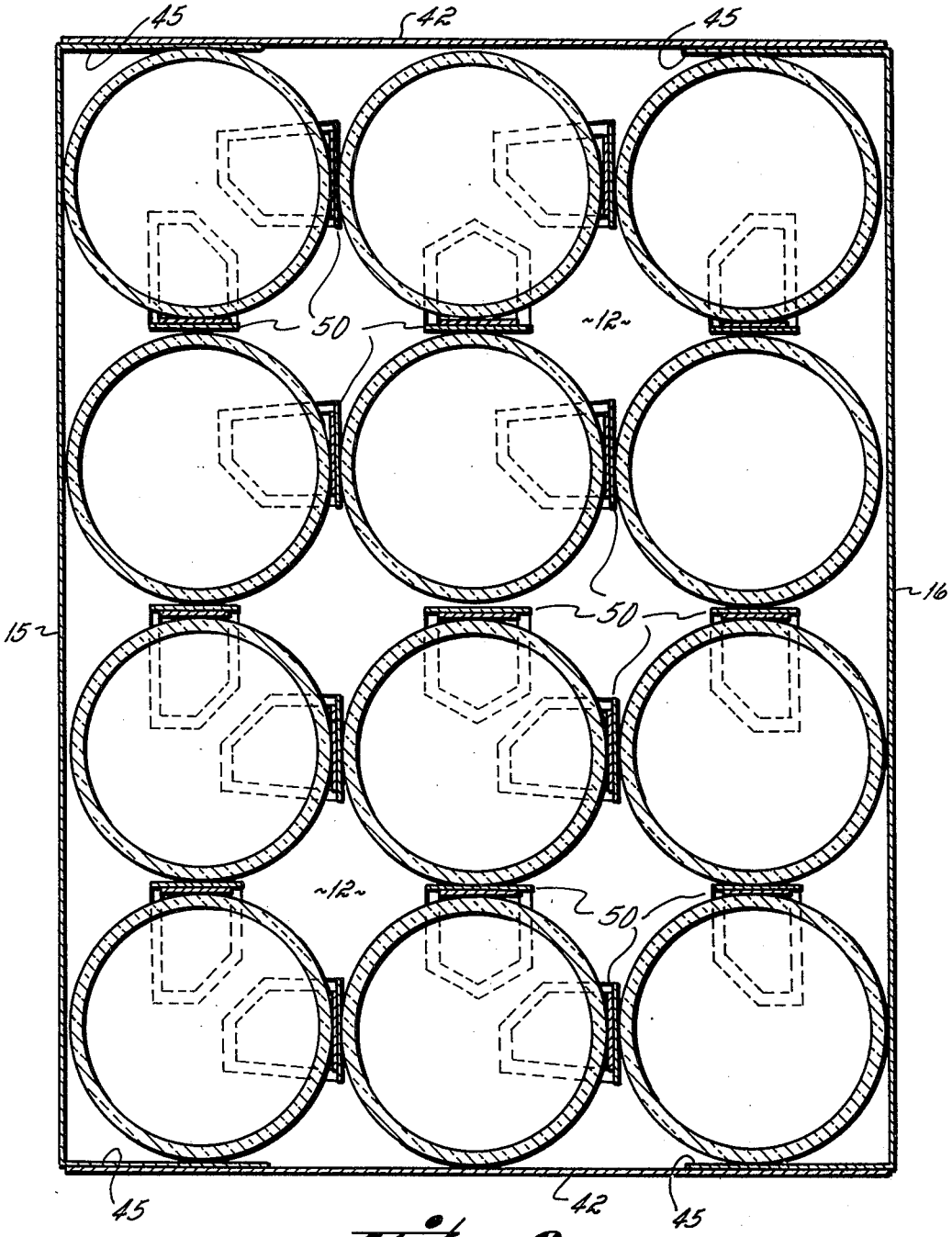
FIG. 9 is a cross-sectional view taken along lines 9—9 of FIG. 8.

The double thickness of the tabs 50 provides for substantial separation of the bottom portions of the bottles from each other, as shown in FIG. 9, thereby preventing contact which might tend to damage the bottles as they are being handled or shipped.

We claim:

1. A carton for bottles comprising, a bottom panel, vertical end panels hinged to the bottom panel, a top panel hinged to the end panels, said top panel having a) a center section hinged to the end panels, b) a pair of intermediate sections hinged to said center section on said first hinge lines, c) a pair of side sections hinged to said intermediate sections on second hinge lines, d) three bottle neck receiving openings on each hinge line, and side flaps hinged to said bottom panel and adapted to be secured to said side sections, whereby, with said intermediate and side sections swung upwardly, a first row of bottles may be introduced into each side of said carton until their necks engage said holes on the first hinge line, said intermediate side sections may be swung to a horizontal attitude to capture said first row of bottles, a second row of bottles may be inserted into each side of said carton until their necks engage said holes on said second hinge line and thereafter said side sections may be swung down and glued to said side flaps.

2. A carton as in claim 1 in which said bottom panel is a double thickness of paperboard.

3. A carton as in claim 2 further comprising, a plurality of bottle separating tabs struck from said bottom panel and hinged thereto, said tabs, when swung to a vertical orientation, providing a double thickness separator located between adjacent bottles.

4. A carton as in claim 3 in which the hinge lines of each tab are offset from each other to permit said tabs to be swung to a vertical orientation.

* * * * *